US006738024B2

(12) United States Patent
Butler et al.

(10) Patent No.: US 6,738,024 B2
(45) Date of Patent: May 18, 2004

(54) MECHANISM FOR DIFFERENTIAL DUAL-DIRECTIONAL ANTENNA ARRAY

(75) Inventors: Derek A. Butler, North Gower (CA); Michael R. Martin, Ottawa (CA); Peter C. Strickland, Ottawa (CA)

(73) Assignee: EMS Technologies Canada, Ltd., Ottawa (CA)

( * ) Notice: Subject to any disclaimer, the term of this patent is extended or adjusted under 35 U.S.C. 154(b) by 75 days.

(21) Appl. No.: 10/166,702

(22) Filed: Jun. 12, 2002

(65) Prior Publication Data

US 2002/0196193 A1 Dec. 26, 2002

Related U.S. Application Data

(63) Continuation-in-part of application No. 09/886,116, filed on Jun. 22, 2001, now Pat. No. 6,407,714.

(51) Int. Cl.[7] ..... H01Q 3/00
(52) U.S. Cl. ..... 343/766; 343/757
(58) Field of Search ..... 343/754, 757, 343/765, 766, 878, 882

(56) References Cited

U.S. PATENT DOCUMENTS

| | | | | | |
|---|---|---|---|---|---|
| 2,740,962 | A | * | 4/1956 | Hammond | 343/765 |
| 2,999,235 | A | * | 9/1961 | Segebaden et al. | 343/765 |
| 3,022,506 | A | * | 2/1962 | Goebels et al. | 343/765 |
| 3,916,415 | A | * | 10/1975 | Howery | 343/754 |
| 3,956,979 | A | | 5/1976 | Coroneos | 99/421 |
| 4,427,984 | A | | 1/1984 | Anderson | 343/764 |
| 4,484,486 | A | | 11/1984 | Staehlin | 74/96 |
| 4,771,290 | A | | 9/1988 | Storey, Jr. | 342/458 |
| 5,420,598 | A | * | 5/1995 | Uematsu et al. | 343/765 |
| 6,198,458 | B1 | * | 3/2001 | Heinz et al. | 343/757 |
| 6,204,823 | B1 | * | 3/2001 | Spano et al. | 343/766 |
| 6,243,046 | B1 | * | 6/2001 | Aoki | 343/765 |
| 6,243,052 | B1 | * | 6/2001 | Goldstein et al. | 343/895 |
| 6,356,239 | B1 | * | 3/2002 | Carson | 343/765 |

FOREIGN PATENT DOCUMENTS

| | | | |
|---|---|---|---|
| DE | 4405644 | 10/1994 | H01Q/1/18 |
| GB | 2 266 996 A | 11/1993 | H01Q/3/08 |

* cited by examiner

*Primary Examiner*—Hoang V. Nguyen

(57) ABSTRACT

A drive mechanism for an antenna array mounted on a moving vehicle. The antenna array is mounted on a disc having two motors which, cooperatively, rotate the disc and rotate a number of antenna elements mounted on the disc. By rotating the antenna elements, the main lobe of the array may be scanned towards a satellite in the elevation plane. To track a moving source from a moving vehicle, one of the motors rotates the disc as a whole, thereby scanning the beam in the azimuth plane. Each antenna element is at an angle to the vertical so that, by rotating the disc to face the direction of the signal source, such as a satellite, a better signal can be obtained.

12 Claims, 5 Drawing Sheets

MECHANISM FOR DIFFERENTIAL DUAL-DIRECTIONAL ANTENNA ARRAY

This application is a continuation-in-part of U.S. application Ser. No. 09/886,116 filed Jun. 22, 2001, now U.S. Pat. No. 6,407,714.

FIELD OF THE INVENTION

The invention relates to rotating antenna arrays with plural antenna elements which can be individually rotated to change the phase of the signal of the individual antenna elements, altering the direction of the main lobe of the antenna.

BACKGROUND TO THE INVENTION

Current aircraft-satellite communications require an antenna design which is capable of phase scanning. On small aircraft, another requirement is that the physical dimensions of the design be small. Conventional phase scanned arrays use digitally controlled diode phase shifters that introduce substantial losses in the RF path. These losses degrade the antenna gain and increase the antenna noise temperature resulting in a very low gain/temperature characteristic for a given antenna size.

Future aeronautical satellite communications antennas will serve multiple purposes such as providing voice communications to the cockpit and cabin, data and internet services, and live video entertainment. The transmission of multiple simultaneous voice and data carriers can produce intermodulation products that may interfere with other navigation and communications systems on the aircraft and on the ground.

Transmission and reception over the Inmarsat network from aircraft demands an antenna whose beam can be scanned over most of the upper hemisphere, allowing the beam to be directed towards the satellite regardless of the aircraft orientation. This beam steering can be achieved using mechanically steered antennas. These are usually mounted inside the top of the stabilizer where size limitations are critical. Access to the tail is quite difficult on large commercial aircraft due to the size and weight of the tail-fin radome and the height of the tail.

Current technologies in mechanically steered arrays do not allow for maximum flexibility in phase scanning and satellite tracking. One technology, disclosed in U.S. Pat. No. 4,427,984 issued to Anderson attempted to solve this problem. Anderson discloses an antenna array with rotatable antenna elements. The phase of the antenna elements are changed to move the lobe of the array to point towards a satellite or signal source. However, Anderson does not disclose how the whole array may be rotated to track a satellite in two planes from a mobile platform. As such, Anderson is only suitable for tracking in a single plane and cannot be used to scan a beam in both elevation and azimuth as required for mobile satellite communications.

Other technologies have tried to provide platforms for other antenna types. Specifically, dish antennas have been tried as the antenna element for numerous antenna platforms. German Patent DE 4 405 644 issued to Braun et al., UK Patent GB 2266 996 issued to Racal Research Limited have both tried this approach. Unfortunately, such an approach leads to complex mechanical systems which require time consuming and labour intensive maintenance. In addition, such antennas are very tall and are thus not suitable for mounting in restricted spaces.

Another approach, shown in U.S. Pat. No. 4,771,290 issued to Storey, uses a rotating platform for a ranging system. However, Storey does not mention using such a platform for an antenna system for aircraft use.

From the above, there is a need for a low profile antenna drive system which is capable of tracking a satellite from a mobile platform. Such an antenna should be readily adaptable for aircraft use or for use with any other moving vehicle and must be of a low cost, reliable design.

SUMMARY OF THE INVENTION

The current invention provides a steerable antenna array and a drive mechanism for an antenna array mounted on a moving vehicle. The antenna array is mounted on a disc having two motors which, cooperatively, rotate the disc in the azimuthal plane and rotate a number of antenna elements mounted on the disc about the boresight axis of the elements. By rotating the antenna elements as aforesaid, the main lobe of the array may be scanned towards a satellite in the elevation plane. To track a moving source from a moving vehicle, one of the motors rotates the disc as a whole, thereby scanning the beam in the azimuth plane. Each antenna element is positioned at an angle to the vertical so that, by rotating the disc to face the direction of the signal source, such as a satellite, and rotating selected elements, the main lobe of the antenna can be painted at the source, and a better signal can be obtained.

In a first embodiment, the current invention provides a drive mechanism for rotating multiple rotatable antenna elements mounted on a rotatable pallet having a first side and a second side. The mechanism comprises a main motor for rotating the rotatable antenna elements about the boresight axis, a secondary motor for rotating the pallet, and rotating means for rotating the rotatable antenna elements. The rotating means is coupled to the main motor and to each rotatable antenna element.

In a second embodiment, the current invention provides a drive mechanism for rotating multiple antenna elements mounted on a first side of a pallet rotatable about an axis. The mechanism comprises a rotation mechanism for rotating said rotatable antenna elements, a main motor for rotating said rotatable antenna elements and coupled to at least a portion of said rotatable antenna element through the rotation mechanism, and a secondary motor for rotating the pallet. Also included in the mechanism are a plurality of shafts mounted on a second side of said pallet, each of the shafts being rotatable about its longitudinal axis with the axis being parallel to the pallet. Further included are a plurality of shaft gears, each shaft gear being mounted on a shaft such that a longitudinal axis of a shaft gear is parallel to the longitudinal axis of the shaft and such that rotation of the shaft causes rotation of the shaft gear, a plurality of antenna gears, each antenna gear being mounted on a distal end of a rotatable antenna element, the distal end protruding through a second side of the pallet, and at least one primary transmission means coupled to the main motor and to at least one of said shafts. Each shaft gear is in contact with an antenna gear such that a rotation of a shaft gear causes rotation of an associated antenna gear and a rotation of an antenna gear causes rotation of an antenna element. Activation of the main motor causes at least one primary transmission means to cause at least one of said shafts to rotate.

In a third embodiment, the current invention provides a mechanism for rotating multiple antenna elements mounted on a first side of a pallet rotatable about an axis. The mechanism comprises a main motor for rotating said rotatable antenna elements, a secondary motor for rotating the pallet, and a plurality of slots in the pallet. The rotating means includes a slider pallet located adjacent a second side of the pallet with the slider pallet being rotatable about a slider pallet axis. Also included in the rotating means are a plurality of slider mounts mounted on the first side of the pallet with each slider mount being slidably mounted inside a slot and a plurality of slider cords, each slider cord being wrapped around a portion of a rotatable antenna element. Each slider cord is attached to a slider mount such that slidably moving a slider mount within its associated slit causes its associated rotatable antenna element to rotate. The rotating means further includes a plurality of slider cars mounted on the slider pallet, each of said slider cars being coupled to at least one slider mount, first coupling means to couple the main motor to the slider pallet, and second coupling means to couple the secondary motor to the pallet. The axis of the pallet and the slider pallet axis are substantially collinear. The main motor is coupled to the slider pallet for rotating the slider pallet about the slider pallet axis and the secondary motor is coupled to the pallet for rotating the pallet about the pallet axis. Rotating the pallet and the slider pallet at different rotational speeds causes the rotatable antenna elements to rotate.

BRIEF DESCRIPTION OF THE FIGURES

A better understanding of the invention may be obtained by reading the detailed description of the invention below, in conjunction with the following drawings, in which.

DESCRIPTION OF THE PREFERRED EMBODIMENT

Figure 1:
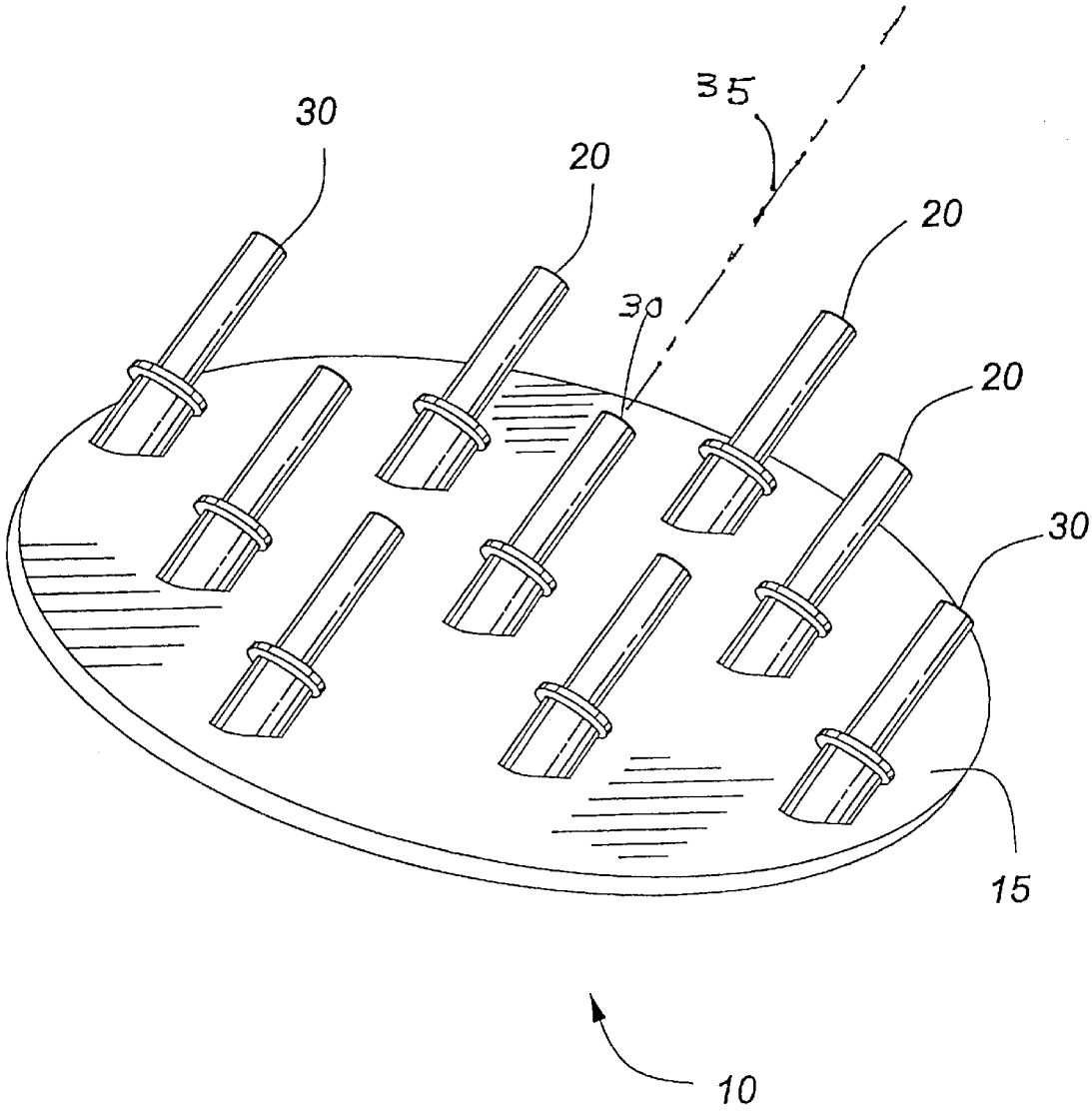
FIG. 1 is a top view of a rotatable dual directional antenna array.

Referring to FIG. 1, a top view of an antenna array 10 is illustrated with rotatable antenna elements 20 mounted on a first side of a pallet 15. Also mounted on the same side of the pallet 15 are non-rotatable antenna elements 30. The antenna has a boresight axis 35. Preferably the antenna elements are helical antennas.

Figure 2:
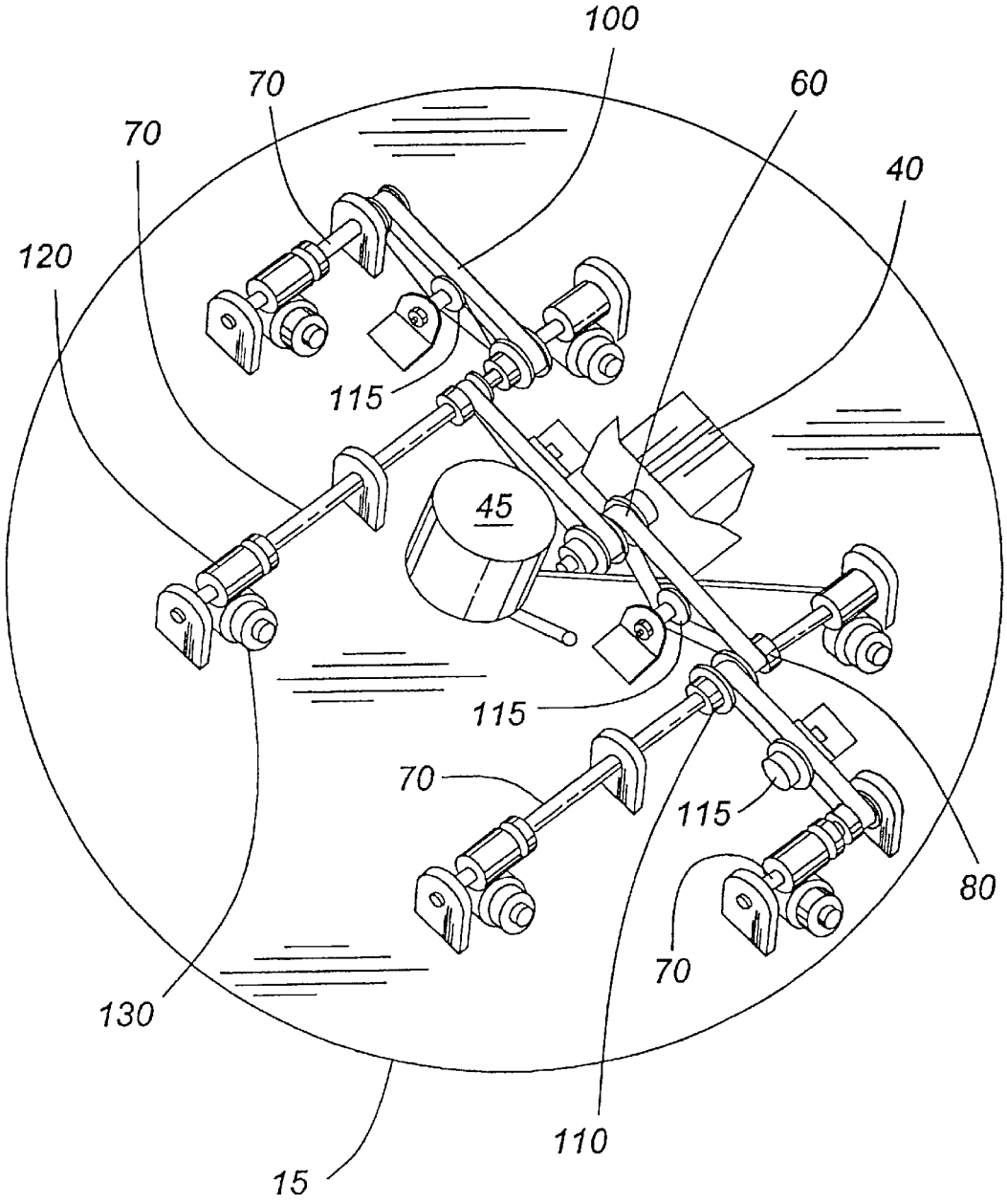
FIG. 2 is a first lower perspective view of the bottom of a pallet illustrating a mechanism for operating the antenna array of FIG. 1.
Figure 3:
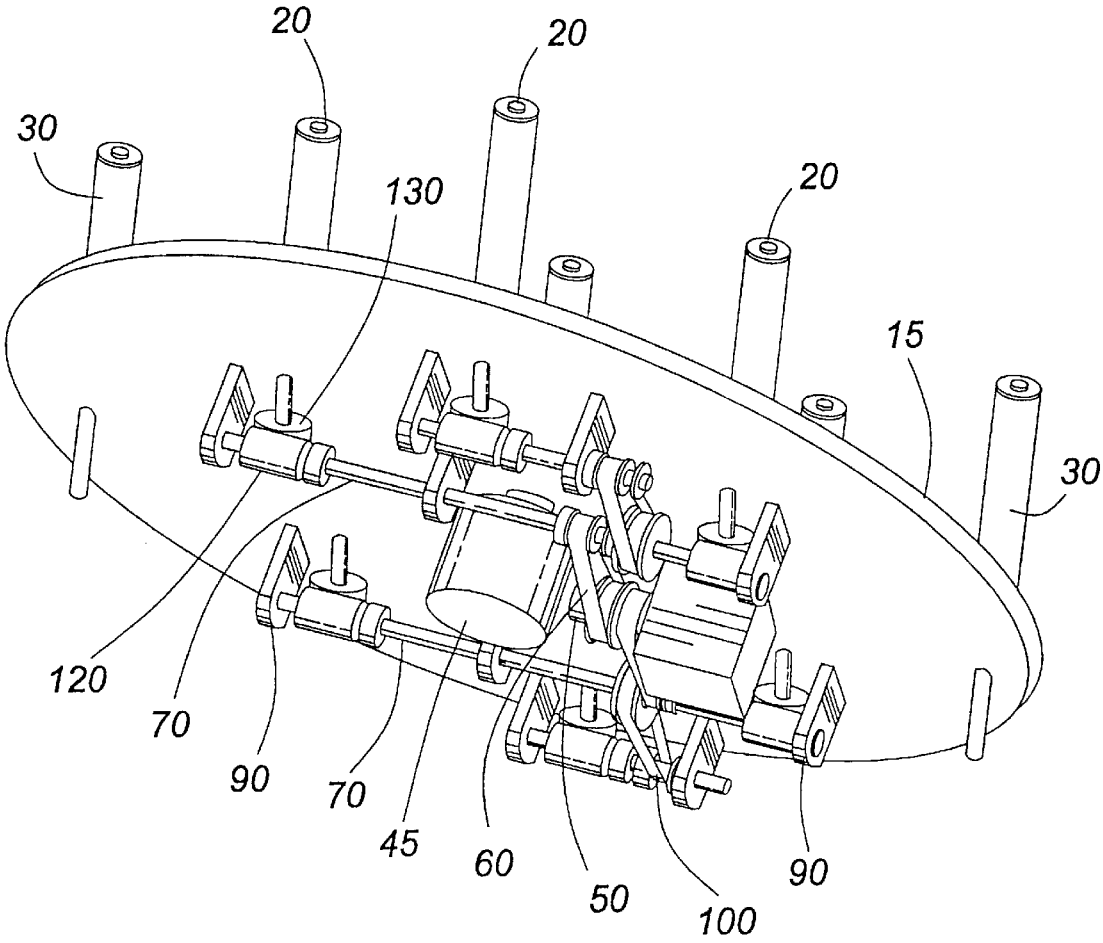
FIG. 3 is a second lower perspective view of the antenna array of FIG. 1 showing the bottom of the pallet illustrated in FIG. 2 from a different angle.

Referring to FIGS. 2 and 3, different views of the second side of the pallet 15 of FIG. 1 are shown. A main motor 40, having main motor shafts 50, is mounted, along with a secondary motor 45 on the second side of the pallet 15. Coupled to the main motor shaft 50 are belts 60. The belts 60, are coupled on their other end to array shafts 70 via connection points 80. In the illustration, connection points 80 are embodied as pulleys. The array shafts 70 are rotatably mounted, using shaft mounts 90, on the same side of the pallet 15 as the main motor 40. Also illustrated in FIGS. 2 and 3 are secondary belts 100, which couple two array shafts 70 together. These secondary belts 100 couple two array shafts 70 via secondary connection points 110, also embodied as pulleys in the illustration. Tensioners 115 are also shown in FIG. 2. These tensioners provide tension to secondary belts 100. As shown in FIG. 3, on each array shaft 70 is at least one shaft gear 120. This shaft gear 120 is in contact with an antenna gear 130. Each antenna gear 130 is mounted on one end of a rotatable antenna element 20. The antenna gear 130 and shaft gear 120 assembly is embodied as a worm gear in the illustration.

To explain the workings of the platform 10, the starting point must necessarily be the main motor 40. Upon activation of the main motor 40, the main motor shaft 50 rotates, thereby causing the belts 60 to turn. When the belts 60 turn, this in turn causes all the array shafts 70 to rotate, either by being directly driven by belts 60 or driven by secondary belts 100. (The secondary belts 100 are turned by the rotation of the shafts 70. Any shafts 70 coupled to secondary belts 100 are therefore rotated as well). Once a shaft 70 is rotated, the contact between a shaft gear 120 and its associated antenna gear 130 causes the antenna gear 130 to rotate about its longitudinal axis. Since the rotatable antenna element 20 is free to rotate, rotation of its antenna gear 130 directly rotates the rotatable antenna element 20 about its longitudinal axis. To control the amount of rotation of each rotatable antenna element 20, specific gear ratios between the shaft gear 120 and the antenna gear 130 must be chosen. By judiciously choosing such gear ratios, fixed incremental rotations can be achieved. As an example, the rotatable antenna elements 20 farthest from the centre of the platform could have the smallest gear ratios between its shaft gears 120 and its antenna gears 130. This would cause these outermost rotatable antenna elements to have the largest amount of rotation per turn of the main motor shaft. The innermost rotatable antenna elements could have the largest gear ratio between its shaft gears 120 and its antenna gears 130, thereby causing these innermost rotatable antenna elements to have the smallest amount of rotation per turn of the main motor shaft.

Because of the above arrangement, and by choosing the right gear ratios, one rotatable antenna element can, for every rotation of main motor shaft, rotate N degrees. Another element can rotate −N degrees and yet another can rotate N/2 degrees. To facilitate this incremental rotation, the belts 60 can be attached to a well known motor pulley which rotates in precise increments. A stepping motor can be used as the main motor 40 to allow precise incremental rotation of the main motor shaft 50. The belts 100 are well known toothed timing belts, transmitting the motion of the belts 60 to the array shafts 70. At connection points 80, a shaft pulley is used in cooperation with the timing belt (belt 100) to rotate the array shaft 70. This shaft pulley transmits the motion from the timing belts to the shaft and maintains a fixed turns ratio (gear reduction) when appropriately selected with the motor pulley. As noted above, the shaft gear 120 and antenna gear 130 assembly can be implemented using a worm gear and a drive worm. Each shaft gear 120 can be a drive worm and each antenna gear 130 can be a worm gear. The drive worm distributes rotational energy to the worm gear and changes the rotational axis through 90 degrees to the shaft 70. The worm gear, depending on the orientation of the rotatable antenna element relative to vertical, can be at an angle other than 90 degrees to the drive worm. In the embodiment illustrated in FIGS. 2 and 3, the worm gear is 45 degrees to the drive worm. The secondary belts 100 cooperate with shafts 70 at secondary connection points 110. Connection points 110 can be shaft pulleys which transfer the rotational energy of one shaft to another shaft further away from the main motor 40.

As noted above, the worm gear can be at an oblique angle to the drive worm if the rotatable antenna element is at an angle to the platform. As can be seen from FIG. 1, the antenna elements, both rotatable and non-rotatable, are at an angle to the plane of the pallet 15. In the embodiment illustrated in the FIGS. 2 and 3, the elements are angled at 45 degrees to the pallet.

In the embodiment illustrated in FIGS. 2 and 3, both clockwise and counter clockwise rotation of the rotatable antenna elements can be obtained for a given turn of the main motor shaft. Depending on which side of the shaft gear the antenna gear is mounted on, a fixed turn of the main motor shaft will produce either a clockwise or a counter-clockwise rotation of a rotatable antenna element.

It should be noted that the drive worm/worm gear arrangement can be replaced by bevel gears or any other suitable gearing mechanism.

Figure 4:
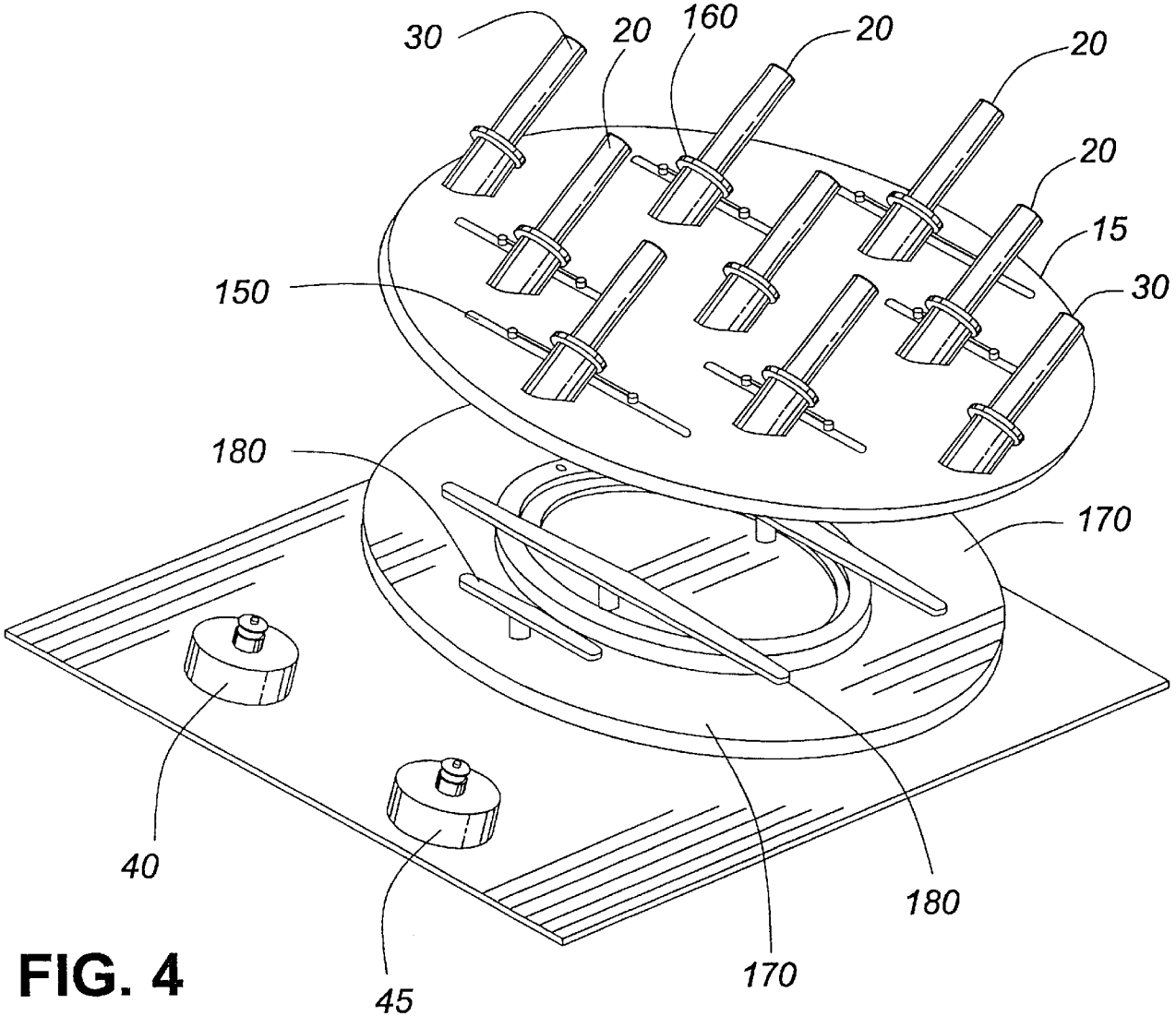
FIG. 4 is an exploded perspective view of a second embodiment of the mechanism illustrated in FIG. 2.
Figure 5:
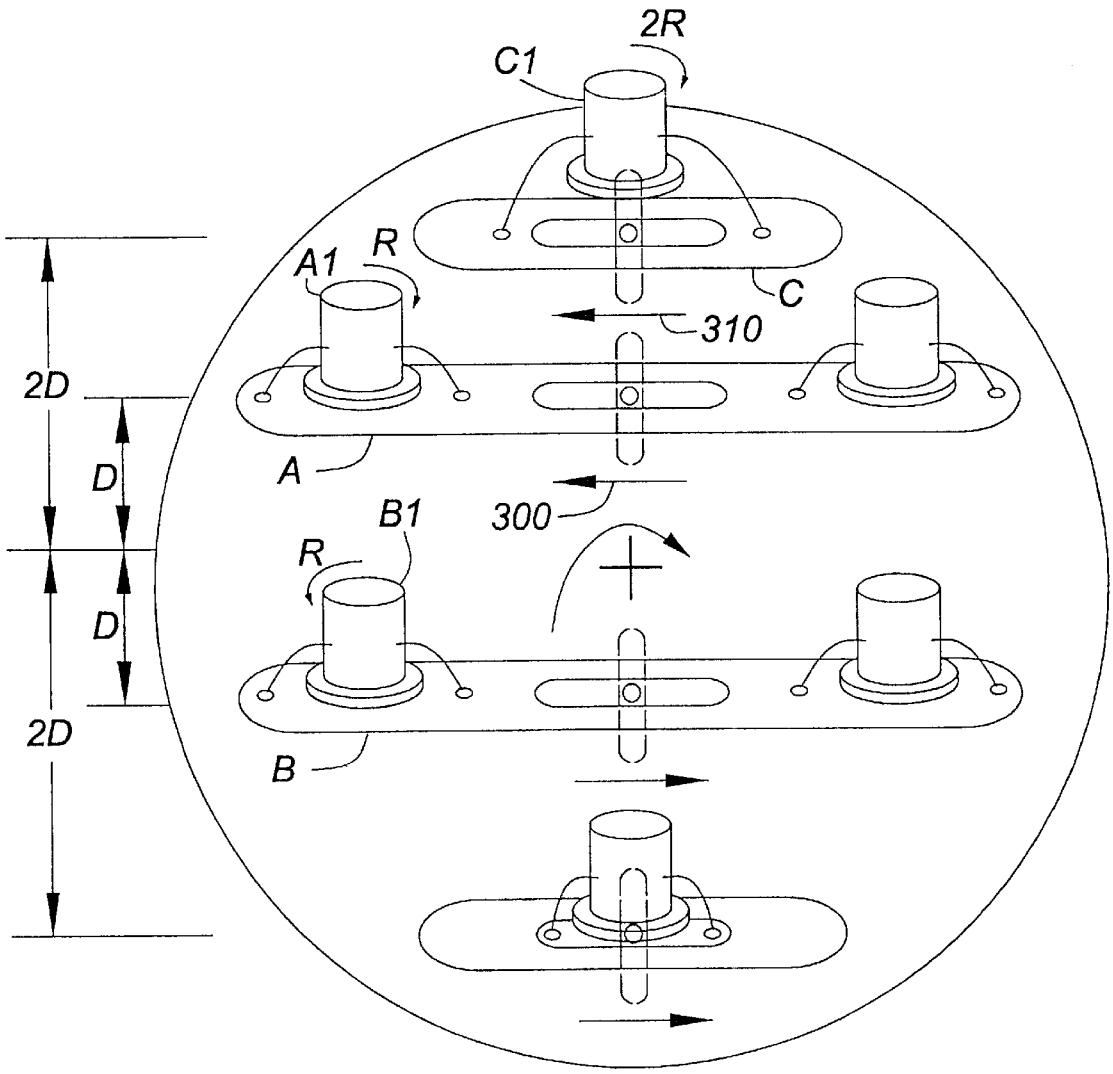
FIG. 5 is a plan view of a portion of the embodiment illustrated in FIG. 4 illustrating the relationships between the distance travelled by a slider and the angular distance travelled by an element mounted on that slider.

Another mechanism for rotating the antenna elements mounted on the pallet 15 is illustrated in FIG. 4. FIG. 5 is a more detailed view of this mechanism. The pallet 15 has a number of slots 140. Within each slot 140 is a slider mount 150, each slider mount 150 being slidable within a slot 140. Wrapped around the rotatable antenna element 20 is a slider cord 160. Both ends of a slider cord 160 are attached to a slider mount 150. The slider cord 160 is wrapped around the rotatable antenna element 20 such that the rotatable antenna element 20 rotates when the slider mount is moved either left or right. When the slider mount 150 is slid across the slot 140, this causes the rotatable antenna element 20 to rotate about its longitudinal axis.

Also in this embodiment, a slider pallet 170 is located beneath the pallet 15. Mounted on the slider pallet 170 are slider cars 180, each of which is fixedly attached to a slider mount 150 through holes in the pallet 15. The slider pallet 170 is rotatable about its central axis independently of the pallet 15. The pallet 15 is also rotatable about its central axis. Ideally, the central axes of the pallet 15 and the slider pallet 170 are collinear so that the pallet 15 and the slider pallet 170 may rotate about the same axis. Located away from the pallet 15 and the slider pallet 170 are the main motor 40 and the secondary motor 45. The main motor 40 rotates the slider pallet 170 about its axis and the secondary motor 45 rotates the pallet 15 about its axis. By judiciously rotating the pallet 15 and the slider pallet 170 at different speeds, the slider mounts 150, because they are attached to the slider cars 180, slide within their respective slots 140. In doing so, the associated rotatable antenna element is rotated.

To rotate the rotatable antenna elements, the pallet 15 and the slider pallet 170 are rotated at varying velocities relative to each other. If they are rotated at the same rate, then the slider cars experience no relative motion and the rotatable antenna elements remain stationary on their respective axes. If one of the pallets 150 or 170 is rotated at a rate different from the other pallet, then the slider cars experience motion relative to the pallet 15. This causes the slider mounts 150 to slide in their slots 140. When this occurs, the rotatable antenna elements are rotated by way of the slider cords. To control the rate or angular distance of rotation of each rotatable antenna element, the distance of the slider mount from the central axis of the two pallets determines how far the slider mount moves in its slot. Accordingly, this also determines how much the associated rotatable antenna element rotates. Thus, the farther the slider mount is from the central axis, the more its associated rotatable antenna element rotates for a given differential in motion between the pallet and the slider pallet.

It should be clear that both clockwise and counterclockwise rotation of the antenna elements are possible with the embodiment in FIG. 4. Sliders on opposite sides of the center of the rotating pallet would have opposite directions of rotation. The sliders are driven from the "neutral" or central axis of the pallet. (It should be noted that in FIG. 4, the nonrotatable elements 30 are on a centerline of the pallet. The middle nonrotatable element is at the center axis of the pallet.) FIG. 5 illustrates the mechanism of the sliders and how they operate. It should be noted that FIG. 5 does not illustrate the whole pallet and is only provided to clarify the relationships and interactions between the sliders and the rotation of the pallet. A slider that is a distance D from the center of the pallet would rotate its attached element R degrees in one direction. A slider that is a similar distance D from the center but is on the opposite side of the central axis would have its element experience a rotation of R degrees in the other direction. Thus, if a slider A is D units away from the center, then the element A1 attached to slider A would rotate R degrees. Slider B, also a distance D units away from the center but on the opposite side of the centerline, would have its element B1 rotate R degrees in a direction opposite to that of element A1. On the other hand, if element C is 2D units away from the center, its attached element C1 would experience a rotation of 2R degrees. Thus, the amount of rotation that an element undergoes is directly proportional to the distance between its associated slider and the center of the pallet.

To further clarify the explanation, if the pallet shown in FIG. 5 rotates in a clockwise manner relative to the lower pallet (not shown in FIG. 5), the slider A will slide to the left as indicated by arrow 300. Slider C, because it is twice as far from the center of the pallet as slider A, will slide in the same direction (arrow 310) but will travel twice the distance of slider A. Thus, since the amount of rotation that an antenna element is dependent on the amount of distance travelled by the slider to which it is attached, element C1 rotates twice as much (2R) as element A1 (R).

To keep each slider aligned within its slot, each slider has at least one pin protruding into and slidable within the slot. This pin or pins provides the attachment to the slider pallet 170. Thus, as the slider pallet 170 moves relative to the pallet 15, the pins slide within each slot, thereby causing each slider to move within each slot as well. This causes each rotatable antenna element to rotate by its slider cord, thereby rotating the rotatable antenna element.

The slider pallet 170 and the pallet 15 are rotated respectively by the main motor 40 and the secondary motor 45 by means of a pulley and belt system.

From the above, it is therefore clear that each rotatable antenna element can be rotated about its longitudinal axis. In the embodiments illustrated, the antenna elements are angled away from the plane of the pallet 15. This provides a much better pointing capability than the prior art. To track a signal source or target, such as a satellite, the secondary motor 45 can rotate the whole pallet 15 about its axis. This way, by rotating the pallet 15 and fixing the antenna elements to angle towards a certain point, a much better signal response can be obtained from a signal source. If the signal source or target were to move to the left of the pallet 15, the secondary motor 45 can rotate the pallet 15 to keep the antenna elements pointed at the source or target. If the source or target were to move towards the horizon of the pallet 15 or towards the centre axis of the pallet 15, rotating the rotatable antenna elements would change the phase of the antenna elements. This would effectively change the vertical direction of the main lobe of the array formed by the antenna elements, thereby changing the direction targeted by the array.

It should also be noted that, while the embodiments described above have their rotation mechanisms underneath the pallet, it is also possible to have such mechanisms mounted atop the pallet.

A person understanding the above-described invention may now conceive of alternative designs, using the principles described herein. All such designs which fall within the scope of the claims appended hereto are considered to be part of the present invention.

We claim:

1. A drive mechanism for rotating multiple rotatable antenna elements mounted on a rotatable pallet having a first side and a second side, the mechanism comprising:

a main motor for rotating said rotatable antenna elements about axes parallel to the boresight axis of the antenna in the azimuthal plane;

a secondary motor for rotating the pallet; and rotating means for rotating said rotatable antenna elements, said rotating means being coupled to the main motor and to each rotatable antenna element, whereby the main lobe of the antenna can be raised and lowered in the elevation plane.

2. A drive mechanism as in claim 1 further including a plurality of slots in the pallet and wherein the rotating means includes:

a slider pallet located adjacent the second side of the pallet, said slider pallet being rotatable about a slider pallet axis;

a plurality of slider mounts mounted on the first side of the pallet, each slider mount being slidably mounted inside a slot;

a plurality of slider cords, each slider cord being wrapped around a portion of a rotatable antenna element, and each slider cord being attached to a slider mount such that slidably moving a slider mount within its associated slot causes its associated rotatable antenna element to rotate;

a plurality of slider cars mounted on the slider pallet, each of said slider cars being coupled to at least one slider mount;

first coupling means to couple the main motor to the slider pallet such that activation of said main motor rotates said slider pallet about said slider pallet axis; and second coupling means to couple the secondary motor to the pallet such that activation of said secondary motor rotates said pallet about the axis of the pallet, wherein the axis of the pallet and the slider pallet axis are substantially collinear;

the main motor is coupled to the slider pallet for rotating said slider pallet about said slider pallet axis;

the secondary motor is coupled to the pallet for rotating said pallet about said axis of said pallet; and rotating the slider pallet in relation to the pallet causes the rotatable antenna elements to rotate.

3. A drive mechanism as in claim 2 wherein the first coupling means is a belt and pulley system coupling a shalt of the main motor to an axis shaft of the slider pallet.

4. A drive mechanism as in claim 1 wherein said rotating means includes:

a plurality of shafts mounted on the second side of said pallet, each of said shafts being rotatable about its longitudinal axis which is parallel to the pallet;

a plurality of shaft gears, each shaft gear being mounted on a shaft such that a longitudinal axis of a shaft gear is parallel to the longitudinal axis of the shaft and such that rotation of the shaft causes rotation of the shaft gear;

a plurality of antenna gears, each antenna gear being mounted on a distal end of a rotatable antenna element, the distal end protruding through a second side of the pallet; and at least one primary transmission means coupled to the main motor and to at least one of said shafts, each shaft gear being contact with an antenna gear such that a rotation of a shaft gear causes rotation of an associated antenna gear;

rotation of an antenna gear causes rotation of an antenna element; and activation of the main motor rotates at least one of said shafts through the primary transmission means.

5. A drive mechanism as in claim 4 wherein the primary transmission means is a belt mechanically coupled to a motor shaft of the main motor and to at least one of the shafts for rotation thereof.

6. A drive mechanism as in claim 4 further including at least one secondary transmission means, each of said secondary transmission means coupling two shafts such that a rotation of one shaft causes rotation of the other shaft.

7. A mechanism as in claim 5 further including at least one secondary transmission means, each of said secondary transmission means coupling two shafts such that a rotation of one shaft causes rotation of the other shaft.

8. A mechanism as in claim 7 wherein each of said secondary transmission means is a belt.

9. A mechanism as in claim 8 further including a plurality of pulleys attached to each of said shafts and to the motor shaft, each of said pulleys cooperating with each primary or secondary transmission means to rotate the shafts when the main motor is activated.

10. A mechanism as in claim 4 wherein each shaft gear is a drive worm and each antenna gear is a worm gear.

11. A mechanism as in claim 4 wherein each shaft gear is a bevel gear and each antenna gear is a bevel gear.

12. A steerable antenna array comprising a plurality of antenna elements mounted on a rotatable planar pallet at an angle to its surface of the pallet, said antenna elements comprising rotatable and non-rotatable elements, the longitudinal axes of the antenna elements being parallel to a boresight axis, means for rotating said rotatable antenna elements independently of rotation of the pallet.

* * * * *